US012600556B2

(12) United States Patent
Verrando

(10) Patent No.: US 12,600,556 B2
(45) Date of Patent: Apr. 14, 2026

(54) INSULATING CONTAINER FOR TAKEAWAY PIZZA

(71) Applicant: Mirco Verrando, Ventimiglia (IT)

(72) Inventor: Mirco Verrando, Ventimiglia (IT)

( * ) Notice: Subject to any disclaimer, the term of this patent is extended or adjusted under 35 U.S.C. 154(b) by 15 days.

(21) Appl. No.: 18/711,754

(22) PCT Filed: Nov. 16, 2022

(86) PCT No.: PCT/EP2022/082143

§ 371 (c)(1),
(2) Date: May 20, 2024

(87) PCT Pub. No.: WO2023/094237

PCT Pub. Date: Jun. 1, 2023

(65) Prior Publication Data

US 2025/0033861 A1 Jan. 30, 2025

(30) Foreign Application Priority Data

Nov. 24, 2021 (IT) ..... 102021000029675

(51) Int. Cl.
*B65D 81/38* (2006.01)
*B65D 25/10* (2006.01)
*B65D 25/28* (2006.01)

(52) U.S. Cl.
CPC ..... *B65D 81/3823* (2013.01); *B65D 25/108* (2013.01); *B65D 25/2858* (2013.01); *B65D 2585/366* (2013.01)

(58) Field of Classification Search
CPC ..... B65D 81/18; B65D 25/32; B65D 1/265; B65D 5/005; B65D 5/001; B65D 81/3823; B65D 25/108; B65D 25/2858; B65D 2585/366; B65D 25/10; B65D 25/2835
See application file for complete search history.

(56) References Cited

U.S. PATENT DOCUMENTS 5,605,231 A * 2/1997 Borsboom ..... B65D 81/3813 426/119
D528,368 S * 9/2006 Maldonado ..... D7/605
8,123,069 B1 * 2/2012 Mumaw ..... B67D 3/0061 294/142
9,211,902 B2 * 12/2015 Vanderberg ..... B62B 1/208
(Continued)

FOREIGN PATENT DOCUMENTS

WO 2017047748 A1 3/2017

OTHER PUBLICATIONS

International Search Report and Written Opinion of the ISA for PCT/EP2022/082143, mailed Feb. 9, 2023, 9 pages.

*Primary Examiner* — Kareen K Thomas
(74) *Attorney, Agent, or Firm* — NIXON & VANDERHYE

(57) ABSTRACT

Insulating container for takeaway pizza made of food-grade material, such as, by way of non-binding example, high-density polyethylene (HDPE) or polypropylene (PP), or pressed paper fibre, capable of using nanotechnological materials for thermal insulation and the rice paper for maintaining the aroma. The present container proposes a clip closure capable of preventing food from spilling, a coupling system which allows the safe stacking with a transportation handle and several other very advantageous small solutions, including two small rings for transporting a beverage.

11 Claims, 2 Drawing Sheets

(56) References Cited

U.S. PATENT DOCUMENTS

| | | | | |
|---|---|---|---|---|
| 12,187,491 | B2 * | 1/2025 | Squiers | B65D 21/086 |
| 12,195,230 | B2 * | 1/2025 | Davidian | B65D 21/0224 |
| 2006/0175223 | A1 | 8/2006 | Casanovas | |
| 2007/0131667 | A1 | 6/2007 | Amato | |
| 2011/0192890 | A1 * | 8/2011 | Chebli | B65D 81/3823 493/56 |
| 2020/0283959 | A1 | 9/2020 | Flynn | |
| 2021/0221557 | A1 | 7/2021 | Forsberg | |
| 2025/0215487 | A1 * | 7/2025 | Mandell | G01N 27/3276 |

* cited by examiner

INSULATING CONTAINER FOR TAKEAWAY PIZZA

This application is the U.S. national phase of International Application No. PCT/EP2022/082143 filed Nov. 16, 2022, which designated the U.S. and claims priority to IT Patent Application No. 102021000029675 filed Nov. 24, 2021, the entire contents of each of which are hereby incorporated by reference.

TECHNICAL FIELD

The present invention relates to the field of takeaway food and beverage containers typically used in pizzerias.

PRIOR ART

In a country like Italy, the land of pizza, an average of one and a half million takeaway pizzas are consumed daily, and a typical takeaway cardboard made of recycled paper is normally used for each one of them. If—on the one hand—the quality of these common containers such as practicability, the fact that they can be recycled, the low cost, the convenience of not engraving or scratching the table when cutting the pizza and so on and so forth are well-known, on the other hand not everyone realises that there are several significant criticalities: firstly, although the common pizza cardboard is recyclable, it should be kept clean and without oily food residues, otherwise not only can they not be recycled but they could even jeopardise the recyclability of the entire batch of paper they belong to; secondly, the material it is made of does not retain the warmth at all and, very often, the pizza is cold by the time it reaches home, even though the trip from the oven to the table lasts just a few minutes; thirdly, there has been widespread legitimate concern on the food safety of these cardboards specifically due to the recycling process, which is carried out by means of harmful chemical substances (for example phthalates) which-when the pizza is hot, beyond 60° C., is placed therein-could be released and therefore subsequently swallowed. Such possibility combines with the wrong habit of many people to place the pizza back into the oven once at home. A habit that would allow the harmful substances to bind with the food, or to eat the pizza directly from the container, without putting it on a plate first, facilitating the continuous intake of these substances over a lifetime and therefore increasing the harmfulness thereof over time. Lastly, these common pizza cardboards are notoriously difficult to transport, can often facilitate the spilling of food or tomato sauce, and should they accidentally fall, they tend to open and all the food falls into the ground. In the light of these observations, it is clear that despite the widespread use thereof, as a product the common pizza cardboard should be avoided or replaced with a more advantageous industrial invention capable of overcoming the drawbacks outlined above.

The object of the present application for industrial patent is therefore to provide a solution that is new and alternative by proposing an insulating container for takeaway pizza made of food-grade material, such as, by way of non-binding example, high-density polyethylene (HDPE) or polypropylene (PP), or made of pressed paper fibre, capable of using nanotechnological materials for the thermal insulation and maintaining the aroma, proposing a clip closure which prevents the food from spilling, a coupling system which allows the safe stacking with a transportation handle and several other small very advantageous solutions described below.

DESCRIPTION OF THE INVENTION

With the present industrial invention patent herein described and claimed is a device provided with at least a solution that is new and alternative to solutions known up to now and/or to meet one or more needs felt in the art and in particular evincible from the above. In order to achieve this object, the inventors developed an insulating container for takeaway pizza made of food-grade material such as, by way of non-binding example, high-density polyethylene (HDPE) or polypropylene (PP), or pressed paper fibre (typically used for containing eggs), which proposes the use of innovative materials for the thermal insulation and the preservation of the aroma. In particular, a ceramic based nanotechnology sheet is proposed as a thermal insulator and a rice paper sheet is proposed as an absorbent: arranged inside a double layer made of food-grade material with which the bottom of the plate is made and therefore without coming into contact with the food, thanks to its incredible insulating properties, the former prevents the dispersion of heat and maintains the temperature for a long time; arranged inside the upper cover, the latter prevents the humidity released by the heat of the pizza from affecting the aroma, making the pizza rubbery. The ceramic microbeads containing air under vacuum are actually produced by means of nanotechnology and they are successfully used in various industrial applications to obtain thermal insulation, while rice paper is a particular light and resistant paper which appears as a layer and it is known for its absorbent and decorative properties.

Furthermore, the alternative materials proposed for manufacturing the container allows to consider using an exterior shape that is much more resistant and functional with respect to conventional cardboards: both the food-grade plastic materials and pressed paper fibres actually have a greater hardness, that is resistance to weight and tension, and they can be easily modelled into complex shapes. Thanks to these characteristics, the container subject of this industrial invention patent application proposes a certain closure clip, between the cover and the plate, that cannot open inadvertently; such clip may be made in various shapes, both by placing the male and female feet on the four corners of the container and by placing a coupling along one of the sides. Secondly, it is proposed that the grooves obtained on the upper outer part of the cover of each container be coupled with the similar feet obtained on the lower outer part of the plates, so that all containers can be stacked and transported safely; above each of the covers, a handle made of folded cardboard is provided, so that the entire stack can be gripped and transported with only one hand.

In order to make the containers even more useful to the customers who use them, it was envisaged to provide a circular-shaped slightly hollow incision on the outer upper side of the cover, so that it is comfortable for placing a glass or a can thereon; at the same time, it was considered that at least a small ring arranged on the inner short side walls, along the height of the container, in which cutlery and/or napkins could be placed, could be useful. For the transportation of canned beverages, there was envisaged the presence of two further optional semi-rigid rings, with standard width, which can be used by the operator who packages the takeaway order. Such rings are fitted into a coupling specifically designed along the outer short side of the container and they hold the beverage in horizontal position.

A variant of the present inventive concept consists in designing a multiple-plane container, adapted to transport and preserve at least two pizzas; said container will have at least a double height and at least an inner shelf for separating at least two food preservation environments. The shelf will consist of two layers of food-grade material within which a ceramic-based nanotechnology sheet is sealed, and it will have a rice paper sheet glued on the outer part faced towards the pizza arranged on the lower plate. The multiple-shelf container, provided with upper and lower couplings described above so as to be stacked with other similar containers, will have at least four optional lateral rings for the transportation of at least two beverages and a handle made of folded carton on the outer side of the upper cover. Said container having a preferably lateral opening for introducing hot pizzas and said opening having at least a relative clip closure.

DESCRIPTION OF THE FIGURES

The advantages above, as well as other advantages and characteristics of the present invention, will be illustrated with reference to the attached drawings, which are to be considered as merely illustrative and non-limiting or non-binding as pertains the present patent application, wherein.

DETAILED DESCRIPTION OF THE INVENTION

Figure 1:
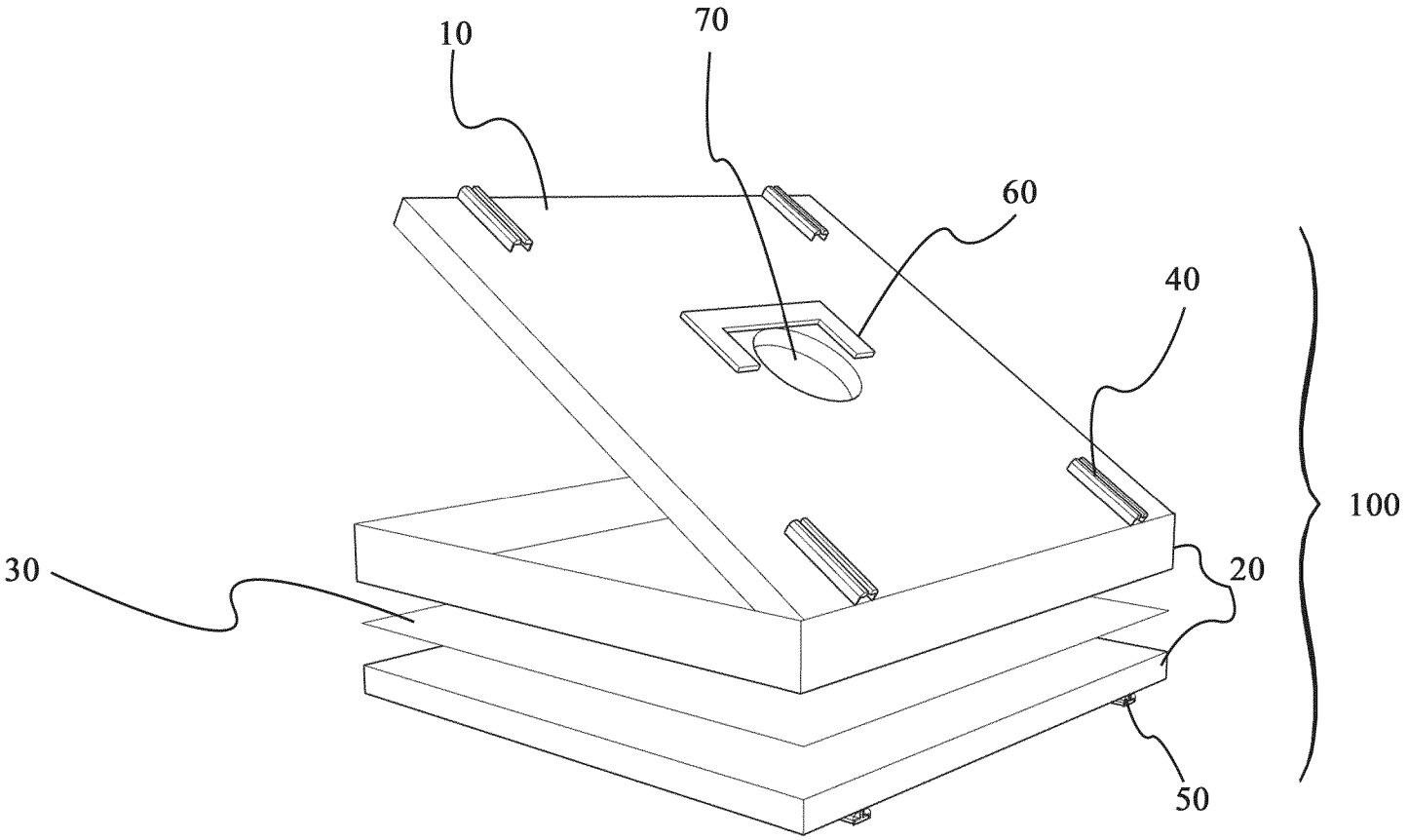
FIG. 1 shows the possible obtainment of a container 100 comprising a lower plate 20 into which a ceramic-based nanotechnology sheet 30 is inserted, and an upper cover 10 having a rice paper sheet glued in the inner side thereof; said lower plate 20 having-modelled on the lower outer surface thereof-feet 50 adapted to be coupled with the incisions 40 modelled on the outer upper surface of the cover 10 of another container 100; on said outer upper surface of said cover 10 there also being arranged a circular-shaped hollow incision 70 adapted to accommodate a beverage and a folded handle 60.
Figure 2:
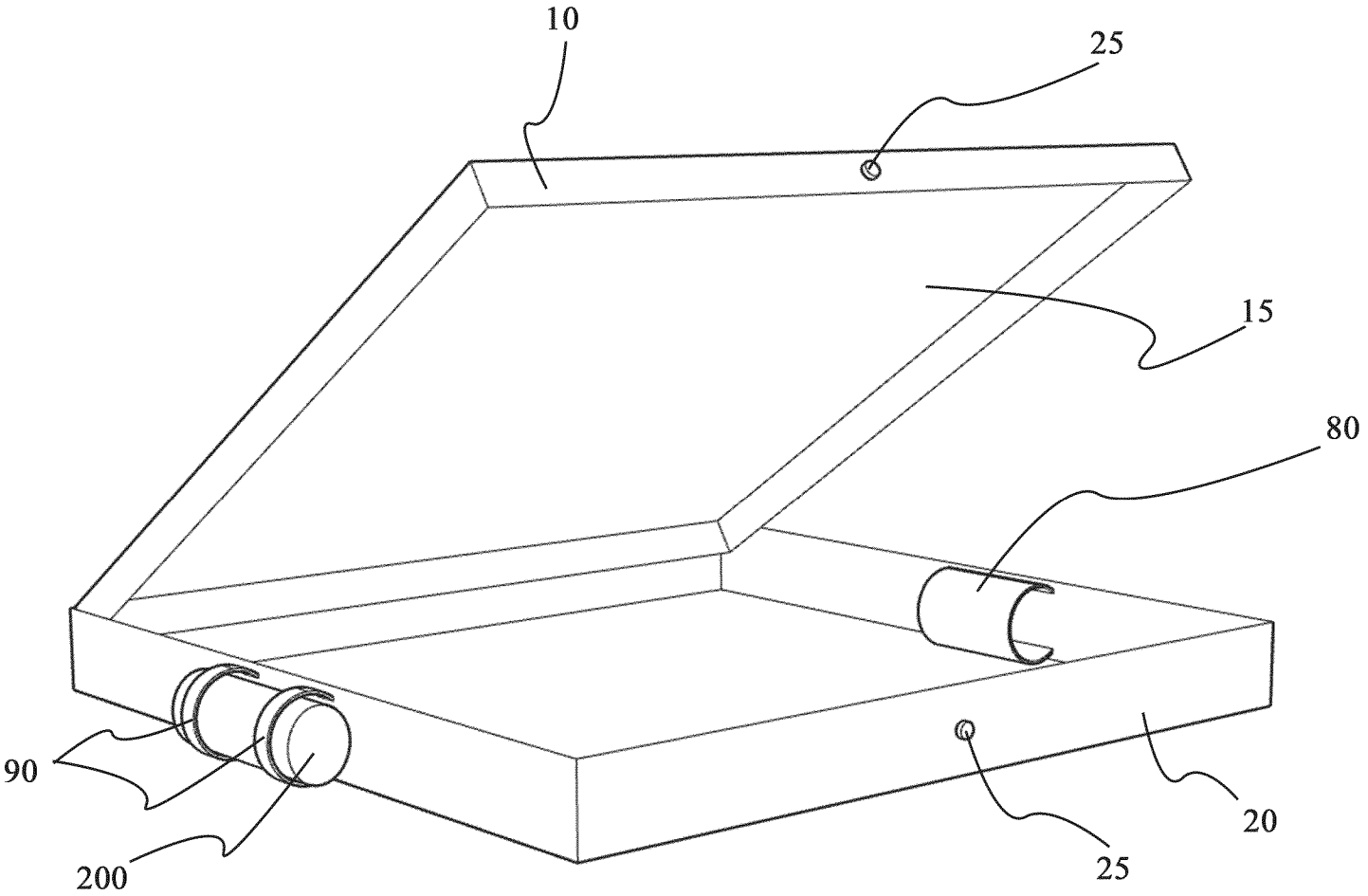
FIG. 2 shows the inner part of the possible obtainment of a container 100 in which the following are shown: the rice paper sheet 15, an inner small ring 80 made of food-grade material adapted to support cutlery and/or napkins, two optional outer small rings 90 for the transportation of a beverage 200 and a clip closure 25.

It will be immediately clear that the description outlined above may be subjected to numerous variations and modifications (for example relating to shape, dimensions, arrangement and parts with equivalent functions) without departing from the scope of the invention as clear from the attached claims.

The present invention will now be illustrated, purely by way of non-limiting or binding example, relating to the present inventive concept, such as a takeaway pizza container 100 made of pressed paper fibre and having an insulating plate 20 consisting of a double layer inside which a ceramic based nanotechnology sheet 30 is contained that is adapted to thermally insulate the interior from the exterior, and a cover 10 on whose inner side a rice paper sheet 15 is affixed that is adapted to retain the hot vapours and moisture released by the food. Given that the container can be stacked together with other identical containers, on the upper outer surface of each cover 10, grooves 40 are provided that are adapted to be coupled with suitable feet 50 modelled on the lower outer surfaces of the insulating plates 20; on each upper outer surface of the covers 10 a circular hollow slight incision 70 is provided that is adapted to place a glass or a beverage thereon, given that the container 100 or the stack can be easily transported with only one hand, also arranged on the same upper outer surface of the cover 10 is a handle made of folded cardboard and which can be opened if necessary. The container 100 thus made is proposed with two further optional instruments: in the inner part, along the vertical surface of the insulating plate 20, a small ring 80 is arranged that is made of semi-rigid cardboard or another food-grade material, adapted to house cutlery and/or napkins; on the outer side of the same surface, engaged with a simple coupling mechanism, two further small rings 90 are arranged having the diameter of a standard can, adapted to house a beverage 200 which is held in horizontal position.

It is clear that modifications, additions or variations which are obvious to a person skilled in the art may be applied to the invention described heretofore without departing from the scope of protection provided by the attached claims.

The invention claimed is:

1. An insulating container for a food, the insulating container comprising:

a cover including an inner-facing surface facing an inner volume of the insulating container;

an insulating plate connected to the cover, the insulating plate comprising two food-grade material layers, the cover and the insulating plate defining the inner volume of the insulating container;

a sheet made of ceramic-based nanotechnology material disposed between the two food-grade material layers; and a sheet made of rice paper configured to retain hot vapors and moisture emitted by the food, the sheet of rice paper being disposed on the inner-facing surface of the cover, wherein the insulating container is configured to thermally insulate an interior of the insulating container without coming into contact with the food.

2. The insulating container according to claim 1, further comprising a clip closure configured to prevent spilling of the food in a case of a fall or an overturning of the container, the clip closure being a snap clip configured to be affixed on vertical surfaces of the cover and the insulating plate by snap feet.

3. The insulating container according to claim 1, wherein the insulating container is configured to be stacked and coupled, so that a tilt of a stack of the insulating container and additional insulating containers prevents the stacked containers from falling laterally, by grooves disposed on an upper outer surface of the cover and corresponding fitting feet disposed on a lower outer surface of the insulating plate.

4. The insulating container according to claim 3, further comprising a handle folded on the outer upper surface of the cover and disposed at a top of the insulating container so that each of the stacked containers is configured to transport the entire stack with only one hand.

5. The insulating container according to claim 1, further comprising at least a circular-shaped hollow incision on an outer upper side of the cover, the circular-shaped hollow incision being configured to facilitate stability of a beverage in a glass or a can placed thereon.

6. The insulating container according to claim 1, further comprising a ring made of food-grade material, the ring being configured to be connected via a coupling disposed on an inner surface of a short side of the container, the ring being configured to house one or more of cutlery and napkins.

7. The insulating container according to claim 1, further comprising two rings made of food-grade material, the two rings having a diameter of a standard can, the two rings configured to be connected by a coupling disposed on an outer surface of a short side of the container, the two rings each configured to retain a generic beverage in a horizontal position.

8. The insulating container according to claim 1, wherein the insulating container is configured to transport at least two pizzas and at least two canned beverages, said container has at least double height and at least an inner shelf for a separation of at least two food preservation environments, said inner shelf comprising the two food-grade material layers within which the ceramic-based nanotechnology sheet is sealed, oriented towards a plane of an upper pizza of the at least two pizzas, said inner shelf having the rice paper sheet glued thereto, oriented towards one of the pizzas disposed in the insulating plate, said container further comprises:

at least four lateral rings configured to transport at least two canned beverages; and a handle made of cardboard folded on an outer upper side of the cover, the handle being configured to transport the container, and said container has a lateral opening configured to receive hot pizzas, the lateral opening having at least a clip closure.

9. The insulating container according to claim 1, wherein the food-grade material is one of a high-density polyethylene (HDPE), a polypropylene (PP), and a pressed paper fiber.

10. The insulating container according to claim 1, wherein the food is a takeaway pizza.

11. The insulating container according to claim 4, wherein the handle is made of cardboard.

* * * * *